US005651719A

United States Patent [19]

Pineau

[11] Patent Number: 5,651,719

[45] Date of Patent: Jul. 29, 1997

[54] TOOLING FOR ABRASIVE BELT MACHINING OF CYLINDRICAL BEARING SURFACES WITH PROVISION FOR MONITORING BEARING SURFACE DIAMETER

[75] Inventor: Jean-Claude Pineau, Chailly En Biere, France

[73] Assignee: Societe Procedes Machines Speciales S.P.M.S., Evry Cedex, France

[21] Appl. No.: 430,365

[22] Filed: Apr. 28, 1995

[30] Foreign Application Priority Data

May 4, 1994 [FR] France ..... 94 05449

[51] Int. Cl.[6] ..... B24B 49/00; B24B 17/00; B24B 21/02

[52] U.S. Cl. ..... 451/8; 451/11; 451/303; 451/307; 451/317; 451/489

[58] Field of Search ..... 198/837; 451/8, 451/11, 24, 40, 49, 62, 303, 307, 313, 317, 318, 489; 340/680

[56] References Cited

U.S. PATENT DOCUMENTS

| | | | |
|---|---|---|---|
| 1,908,048 | 5/1933 | Player et al. | 451/317 X |
| 3,041,792 | 7/1962 | La Fleur | 451/317 |
| 4,682,444 | 7/1987 | Judge et al. | 451/303 X |
| 4,993,191 | 2/1991 | Judge et al. . | |
| 5,058,325 | 10/1991 | Pineau | 451/317 |
| 5,095,663 | 3/1992 | Judge et al. | 451/317 X |
| 5,150,545 | 9/1992 | Esteve | 451/8 |
| 5,210,978 | 5/1993 | Phillips | 451/303 |
| 5,437,125 | 8/1995 | Barton, II | 451/8 |

FOREIGN PATENT DOCUMENTS

| | | |
|---|---|---|
| 0219301 | 4/1987 | European Pat. Off. . |
| 0366506 | 5/1989 | European Pat. Off. . |
| 0338224 | 10/1989 | European Pat. Off. . |
| 0382336 | 8/1990 | European Pat. Off. . |
| 8602-817 | 5/1986 | Germany . |

*Primary Examiner*—Timothy V. Eley
*Attorney, Agent, or Firm*—Beveridge, DeGrandi, Weilacher & Young, LLP

[57] ABSTRACT

Tooling for applying an abrasive belt on a machine for abrasive belt machining of cylindrical bearing surfaces comprises, for each bearing surface to be machined, an arm and three abrasive belt application shoes a first of which is mounted in a top median position on the arm and the other two of which are mounted in a bottom lateral position on two jaws articulated to the arm and coupled together in such manner that they can be clamped together. The arm carries a first shoe having a concave abrasive belt application surface subtending an angle greater than 90° and less than 180° and a gauge with two opposed and horizontally aligned sensors and each jaw carries a second shoe having a concave abrasive belt application surface subtending an angle slightly less than 90° whereby when clamped around the bearing surface to be machined the three shoes together envelope the bearing surface to be machined over an angle of at least 270°, the first above and the second two below the two sensors of the gauge which are disposed on a common diameter of the bearing surface. The tooling has applications in abrasive belt machining of journals and crankpins of crankshafts.

18 Claims, 1 Drawing Sheet

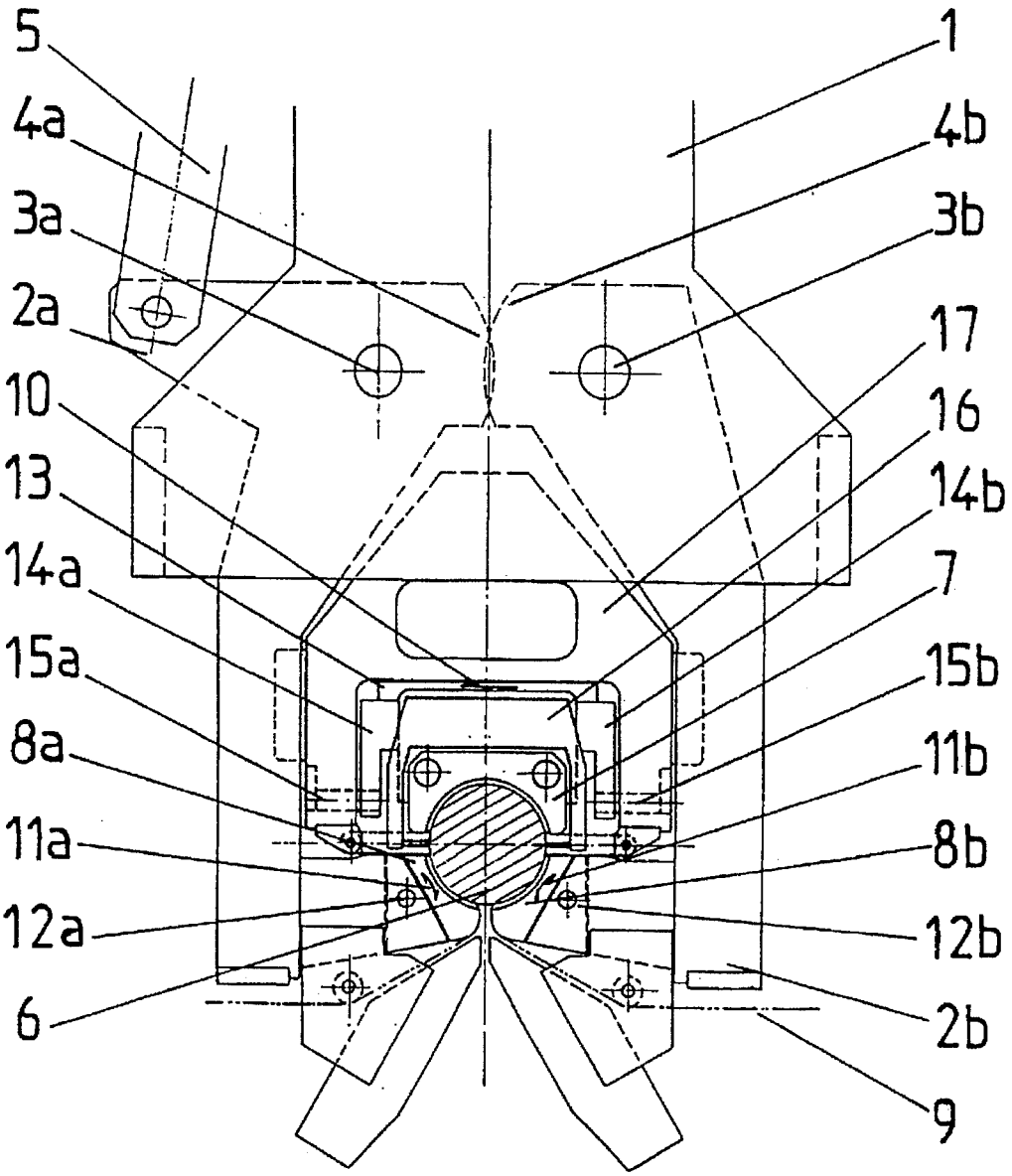
5
4a
3a
2a
10
13
14a
15a
8a
11a
12a
6
1
4b
3b
17
16
14b
7
15b
11b
8b
12b
2b
9

TOOLING FOR ABRASIVE BELT MACHINING OF CYLINDRICAL BEARING SURFACES WITH PROVISION FOR MONITORING BEARING SURFACE DIAMETER

BACKGROUND OF THE INVENTION

1. Field of the Invention

The present invention concerns tooling for abrasive belt machining of cylindrical bearing surfaces on parts, especially journals and crankpins of crankshafts, allowing monitoring of the bearing surface diameter.

2. Description of the Prior Art

The prior art abrasive belt machines described in patent application EP-A-0 366 506 include, for each bearing surface to be machined on a part, a pivoting and vertically mobile arm and three abrasive belt application shoes of which a first is mounted in a top median position on the arm and the other two are mounted in bottom lateral positions on two jaws articulated to the arm and coupled together so that they can be clamped together so that when clamped against the bearing surface to be machined the three shoes are substantially at the three corners of an equilateral triangle.

On these prior art machines, the abrasive belt application shoes have a circular arc shape application surface subtending a relatively small angle, usually less than 30°. These tools produce a good surface state of the bearing surfaces.

Stones have been used for honing cylindrical bearing surfaces on parts, the stones having a circular arc shape surface in contact with the bearing surface to be machined and subtending an angle of up to 60°. However, in use these stones are subject to asymmetrical wear with the result that in practice they apply pressure to (and therefore exert their machining effect on) the bearing surface to be machined over an angle much less than 60°.

On the other hand, honing and abrasive belt machines using stones or shoes subtending angles of more than 30° are better able to compensate defects of shape (ovalization, out-of-round, etc) and defects of straightness of parts, because of their enveloping shape.

Some abrasive belt machines have tools in contact with each cylindrical bearing surface to be machined which include two opposed abrasive belt application shoes disposed on two jaws of a clamp and which can each have a circular arc shape application surface subtending an angle of almost 180°. The drawback of these prior art shoes used in pairs is imperfect distribution of the application pressure. The pressure is inevitably concentrated in the median part of the length of the circular arc shaped surface of each of the two opposed shoes.

On abrasive belt machines with two opposed application shoes, one of the two shoes has been associated with a gauge mounted on one of the jaws and including two opposed and aligned sensors to measure the diameter of the bearing surface during machining and optionally to stop machining when the diameter reaches a predetermined value.

We do not know of any use of a diameter monitoring device on abrasive belt tooling including three enveloping shoes disposed in a triangle, the first on an arm and the other two on two jaws articulated to said arm.

The present invention concerns tooling for application of an abrasive belt to cylindrical bearing surfaces to be machined on parts, especially journals and crankpins of crankshafts, allowing monitoring of the diameter of the bearing surfaces, the tooling including enveloping shoes able to meet severe requirements in respect of the absence of shape defects, the straightness and the precision of the bearing surfaces.

SUMMARY OF THE INVENTION

The invention consists in tooling for applying an abrasive belt on a machine for abrasive belt machining of cylindrical bearing surfaces on parts, especially journals and crankpins of crankshafts, said tooling comprising, for each bearing surface to be machined, a pivoting and vertically mobile arm and three abrasive belt application shoes a first of which is mounted in a top median position on said arm and the other two of which are mounted in a bottom lateral position on two jaws articulated to said arm and coupled together in such manner that they can be clamped together, whereby when clamped against said bearing surface to be machined said three shoes are disposed substantially at the three corners of an equilateral triangle, in which tooling said arm carries a first shoe having a concave abrasive belt application surface subtending an angle greater than 90° and less than 180° and a gauge with two opposed and horizontally aligned sensors below two circumferential ends of said first shoe to measure the diameter of said bearing surface and each jaw carries a second shoe having a concave abrasive belt application surface subtending an angle slightly less than 90° whereby when clamped around said bearing surface to be machined said three shoes together envelope said bearing surface to be machined over an angle of at least 270°, the first above and the second two below said two sensors of said gauge which are disposed on a common diameter of said bearing surface.

The first shoe and the gauge are preferably fixed to a support mounted on the arm with limited freedom of movement in horizontal translation perpendicular to the axis of the bearing surface to be machined. The two second shoes can be mounted on their jaws with limited freedom of movement to oscillate about two axes parallel to the axis of the bearing surface.

The support for the first shoe and the gauge is advantageously mounted on the arm with limited freedom to oscillate about an axis perpendicular to the axis of the bearing surface to be machined.

Said support articulation axis is preferably a small distance under the axis of the bearing surface to be machined.

BRIEF DESCRIPTION OF THE DRAWING

One embodiment of tooling of the invention is described in more detail hereinafter by way of non-limiting illustrative example only and with reference to the appended drawing, the single FIGURE in which is a general view of the bottom part of an abrasive belt machining arm carrying the abrasive belt machining and monitoring tooling of the invention.

DETAILED DESCRIPTION OF THE PREFERRED EMBODIMENT

Referring to the drawing, the abrasive belt machining and monitoring tooling of the invention is used on a machine as described in patent application EP-A-0 366 506 for abrasive belt machining of cylindrical bearing surfaces on parts, especially abrasive belt machining of journals and crankpins of crankshafts.

The single FIGURE of the drawing shows an arm 1 which can pivot freely about a horizontal axis on a slider (not shown) that is mobile vertically. The arm 1 carries two jaws 2*a*, 2*b* articulated to the arm 1 by horizontal pins 3*a* and 3*b* and coupled together by toothed segments 4*a*, 4*b* so that they can be clamped together by synchronous pivoting in opposite directions relative to the arm 1 on operation of a common actuator ram 5.

For abrasive belt machining of a cylindrical bearing surface 6 such as a crankpin or journal of a crankshaft, a first shoe 7 is mounted in a top median position on the arm 1 and two second shoes 8*a* and 8*b* are each mounted in a respective bottom lateral position on the two jaws 2*a*, 2*b* so that after the arm 1 is lowered to apply the first shoe 7 to the bearing surface to be machined operation of the ram 5 clamps the three shoes 7, 8*a* and 8*b* against the bearing surface 6 to apply an abrasive belt 9 against the bearing surface 6 with the three shoes 7, 8*a* and 8*b* substantially at the three corners of an equilateral triangle. The mass of the arm 1 is balanced by means (not shown) such as a controlled feed pressure ram with the result that the three shoes are applied to the bearing surface 6 to be machined with substantially uniform pressure.

For applying the abrasive belt 9 to the bearing surface 6 to be machined the first shoe 7 has a concave application surface subtending an angle slightly less than 180°, about 160° in this example. For applying the abrasive belt 9 to the bearing surface 6 each of the second shoes 8*a* and 8*b* has a concave application surface subtending an angle slightly less than 90°, about 70° in this example. In the clamped position of the shoes 7, 8*a* and 8*b* the shoe 7 envelopes almost all of the upper half of the bearing surface 6 and each second shoe 8*a*, 8*b* envelopes most of a bottom quarter of the bearing surface 6, two diametrally opposed gaps remaining between each circumferential end of the top shoe 7 and the respective top circumferential end of each bottom shoe 8*a*, 8*b*.

The two bottom shoes 8*a*, 8*b* are mounted on the respective jaw 2*a*, 2*b* by pivot pins 12*a*, 12*b* parallel to the axis of the bearing surface 6 in such a way that they have limited freedom of movement in oscillation about the pins 12*a*, 12*b*, as shown by the arrows 11*a*, 11*b*.

The top shoe 7 is mounted on an inverted U-shape support 13 the two arms 14*a*, 14*b* of which each carry a journal 15*a*, 15*b* at their lower end, the two journals 15*a*, 15*b* being aligned horizontally on an axis perpendicular to the axis of the bearing surface 6. They are mounted to pivot about and for movement in translation along their axis at the lower ends of a yoke 17 fixed to the arm 1.

An inverted U-shape gauge 16 including two aligned opposed sensors is also fixed to the support 13 carrying the top shoe 7 so that when the three shoes 7, 8*a* and 8*b* are clamped against the bearing surface 6 to be machined the two sensors lie on a horizontal line corresponding to the diameter of the bearing surface 6 and thus measure the diameter of the latter.

The abrasive belt 9 enters between the two bottom shoes 8*a*, 8*b*, passes between the shoe 8*b* and the bearing surface 6, for example, moves away from the bearing surface 6 to circumvent one sensor of the gauge 16, passes around an idler roller, returns to the bearing surface 6, passes between the top shoe 7 and the bearing surface 6, again moves away from the bearing surface 6 and around an idler roller, to circumvent the other sensor of the gauge 16, returns to the bearing surface 6, passes between the shoe 8*a* and the bearing surface 6, and finally exits between the two shoes 8*a* and 8*b*.

The two journals 15*a* and 15*b* which enable the support 13 and consequently the top shoe 7 and the gauge 16 mounted on the support 13 limited freedom of movement in horizontal translation perpendicular to the axis of the bearing surface 6 (arrow 10) and limited freedom of movement to oscillate about their axis perpendicular to the axis of the bearing surface 6 are offset a small distance above the axis of the sensors of the gauge 16 which, when the shoes 7, 8*a* and 8*b* are clamped around the bearing surface 6, is coincident with a horizontal diametral line of the bearing surface 6.

It goes without saying that the above embodiment of the invention has been shown and described by way of non-limiting illustrative example only and that many modifications and variants are feasible within the scope of the invention.

For example, the top shoe 7 could subtend a smaller angle, but one greater than 90° and preferably greater than 120°, and the bottom shoes 8*a*, 8*b* could each subtend a smaller or greater angle, but preferably one between about 60° and about 80°, so that the three shoes 7, 8*a* and 8*b* together envelope the bearing surface 6 as completely as possible, preferably over an angle equal to or greater than 270°.

In the context of the invention, the sensors of the gauge 16 can be of any type, for example electronic or pneumatic sensors.

There is claimed:

1. A tool for applying an abrasive belt on a machine for abrasive belt machining of bearing surfaces, comprising:

a pivoting and vertically mobile arm;

a pair of jaws mounted and articulated to said mobile arm;

at least first, second, and third abrasive belt application shoes, said second and third shoes being mounted on said pair of jaws;

said first second and third shoes being clampable against said bearing surface where said three shoes are disposed generally triangularly;

said first shoe having a concave abrasive belt application surface subtending an angle greater than 90° and less than 180° and said second and third shoes having a concave abrasive belt application surface; and a gauge with two opposed and horizontally aligned sensors disposed below two circumferential ends of said first shoe to measure the diameter of said bearing surface, said two sensors being disposed on a common diameter of said bearing surface;

whereby said first, second, and third shoes can be clamped together so as to envelope said bearing surface to be machined over an angle of at least 270°.

2. A tool according to claim 1 where said bearing surfaces are cylindrical crankshaft elements.

3. A tool according to claim 1 where said first application shoe is mounted on said arm and in a top median of the bearing surface and the second and third shoes are mounted on said jaws in a bottom lateral position.

4. A tool according to claim 1 where jaw, the concave abrasive belt application surface of said second and third shoes subtends an angle less than 90° and the first, second, and third shoes are disposed at three corners of an equilateral triangle.

5. Tooling for applying an abrasive belt to a workpiece bearing surface on a machine for abrasive belt machining of a cylindrical bearing surface comprising, a pivoting and vertically mobile arm and three abrasive belt application shoes, a first of said shoes mounted in a top median position on said arm, the second and third of said shoes mounted in a bottom lateral position on two jaws articulated to said arm and coupled together in such manner that they can be clamped together, whereby when clamped against said workpiece bearing surface to be machined said three shoes are disposed substantially at the three corners of an equilateral triangle, said arm carrying a first shoe having a concave abrasive belt application surface subtending an angle greater than 90° and less than 180° and a gauge with two opposed and horizontally aligned sensors below two circumferential ends of said first shoe to measure the diameter of said bearing surface, and each of said two jaws carrying said second shoe and said third shoe respectively, each shoe having a concave abrasive belt application surface subtending an angle less than 90° whereby when clamped around said workpiece bearing surface to be machined said three shoes together envelope said workpiece bearing surface to be machined over an angle of at least 270°, the first shoe being above and the second and third shoes being below said two sensors of said gauge, which sensors are disposed on a common diameter of said bearing surface.

6. Tooling according to claim 5 wherein said first shoe has an abrasive belt application surface subtending an angle greater than 120°.

7. Tooling according to claim 5 wherein each second shoe has an abrasive belt application surface subtending an angle between 60° and 80°.

8. Tooling according to claim 5 wherein said first shoe and said gauge are fixed to a support mounted on said arm with limited freedom of movement in horizontal translation perpendicular to the axis of said bearing surface to be machined and said two second shoes are mounted on said jaws with limited freedom of movement to oscillate about axes parallel to said axis of said bearing surface to be machined.

9. Tooling according to claim 8 wherein said support carrying said first shoe and said gauge is mounted on said arm with limited freedom of movement to oscillate about an axis perpendicular to said axis of said bearing surface to be machined.

10. Tooling according to claim 9 wherein said axis of oscillation of said support is at a small distance below said axis of said bearing surface to be machined.

11. Tooling according to claim 10 wherein said support has an inverted U-shape with two arms carrying at their lower ends aligned journals mounted to pivot and move in axial translation on a yoke fixed to said arm.

12. Tooling according to claim 5 wherein said first shoe has an abrasive belt application surface subtending an angle of substantially 160°.

13. Tooling according to claim 5 wherein said first shoe has an abrasive belt application surface subtending an angle of 160°.

14. Tooling according to claim 5 wherein each second shoe has an abrasive belt application surface subtending an angle of approximately 70°.

15. Tooling according to claim 5 wherein each second shoe has an abrasive belt application surface subtending an angle of 70°.

16. Tooling according to claim 5 wherein said workpiece is a crankshaft element.

17. Tooling according to claim 16 wherein said crankshaft element is a crank pin.

18. Tooling according to claim 16 wherein said crankshaft element is a journal.

* * * * *